US005783806A

United States Patent [19]

Hayasaki

[11] Patent Number: 5,783,806

[45] Date of Patent: Jul. 21, 1998

[54] IMAGE HEATING DEVICE USING ELECTROMAGNETIC INDUCTION

[75] Inventor: Minoru Hayasaki, Yokohama, Japan

[73] Assignee: Canon Kabushiki Kaiaha, Tokyo, Japan

[21] Appl. No.: 579,846

[22] Filed: Dec. 28, 1995

[30] Foreign Application Priority Data

Dec. 28, 1994 [JP] Japan ..... 6-328012

[51] Int. Cl.[6] ..... H05B 6/08; G03G 15/20

[52] U.S. Cl. ..... 219/635; 219/665; 219/667; 399/330; 399/336

[58] Field of Search ..... 219/665, 667, 219/666, 663, 661, 635, 626, 627; 399/328, 330, 335, 336

[56] References Cited

U.S. PATENT DOCUMENTS

| | | | |
|---|---|---|---|
| 4,147,910 | 4/1979 | Kiuchi et al. | 219/665 |
| 4,430,542 | 2/1984 | Kondo et al. | 219/665 |
| 4,467,165 | 8/1984 | Kiuchi et al. | 219/665 |

FOREIGN PATENT DOCUMENTS

| | | | |
|---|---|---|---|
| 53-141948 | 12/1978 | Japan | 219/627 |
| 4-249883 | 9/1992 | Japan | 219/667 |
| 5-9027 | 2/1993 | Japan . | |

*Primary Examiner*—Philip H. Leung

*Attorney, Agent, or Firm*—Fitzpatrick, Cella, Harper & Scinto

[57] ABSTRACT

An image heating apparatus includes an electroconductive heat generating element; an excitation coil for producing a magnetic flux, the excitation coil produces a magnetic flux which is effective to generate eddy current in the electroconductive heat generating element to generate heat in the electroconductive heat generating element; an electric circuit for energizing the excitation coil, the electric circuit having a series resonance circuit and a switching element connected with the series resonance circuit; electric power supply control means for controlling the switching element to effect switching between an energization state and non-energization state for the series resonance circuit.

10 Claims, 11 Drawing Sheets

IMAGE HEATING DEVICE USING ELECTROMAGNETIC INDUCTION

FIELD OF THE INVENTION AND RELATED ART

The present invention relates to an image heating device usable with an image forming apparatus such as a copying machine, printer or the like, more particularly to an image heating device wherein eddy current is caused in an electroconductive heat generating element using electromagnetic induction to generate heat.

Japanese Patent Application Publication No. HEI-5-9027 and U.S. application Ser. No. 323,789 now U.S. Pat. No. 5,568,240 disclose a device for heating and fixing an unfixed image on a recording material by heat generated by an electroconductive member using electromagnetic induction. An example is showed in FIG. 10.

In a device using the electromagnetic induction, change of the magnetic flux has to be imparted to the heat generating element which is electroconductive. Therefore, it is required to render the current through an excitation coil on and off at a high frequency.

At a high frequency switching element, there are known a FET (Field Effect Transistor) and BT (Bipolar Transistor), and therefore, use of these elements would be considered. However, in the case of a parallel resonance(voltage resonance) circuit as shown in FIG. 10, a high withstand voltage switching element is required.

From the standpoint of cost, however, low withstand voltage switching elements are more preferable than high withstand voltage ones. Then, it would be considered that an inductance is connected between the switching element and the capacitor in an attempt to use a low withstand voltage switching element.

If this is done, however, a series resonance (current resonance) circuit is constituted by the capacitor and the inductor, and therefore, there arises a liability that the switching element is subjected to thermal damage due to switching loss P=fIVdt (f is a resonance frequency) which occurs transiently upon switching of the switching element from a short circuited state to an opening state.

SUMMARY OF THE INVENTION

Accordingly, it is a principal object of the present invention to provide an image heating device of electromagnetic induction type, which can use a low withstand voltage switching element.

It is another object of the present invention to provide an image heating device using electromagnetic induction wherein damage of the switching element can be avoided.

According to an aspect of the present invention, there is provided an image heating apparatus, comprising; an electroconductive heat generating element; an excitation coil for producing a magnetic flux, the excitation coil produces a magnetic flux which is effective to generate eddy current in the electroconductive heat generating element to generate heat in the electroconductive heat generating element; an electric circuit for energizing the excitation coil, the electric circuit having a series resonance circuit and a switching element connected with the series resonance circuit; electric power supply control means for controlling the switching element to effect switching between an energization state and non-energization state for the series resonance circuit.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Figure 11:
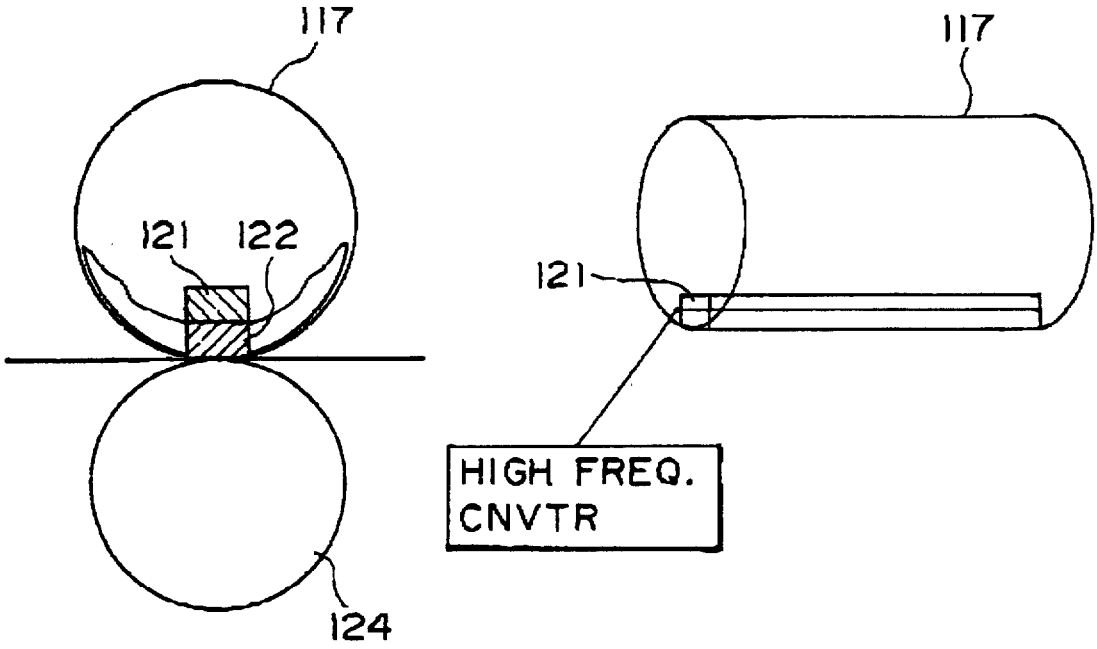
FIG. 11 is a cross-sectional view and a perspective view of an image heating device according to a first embodiment.
Figure 12:
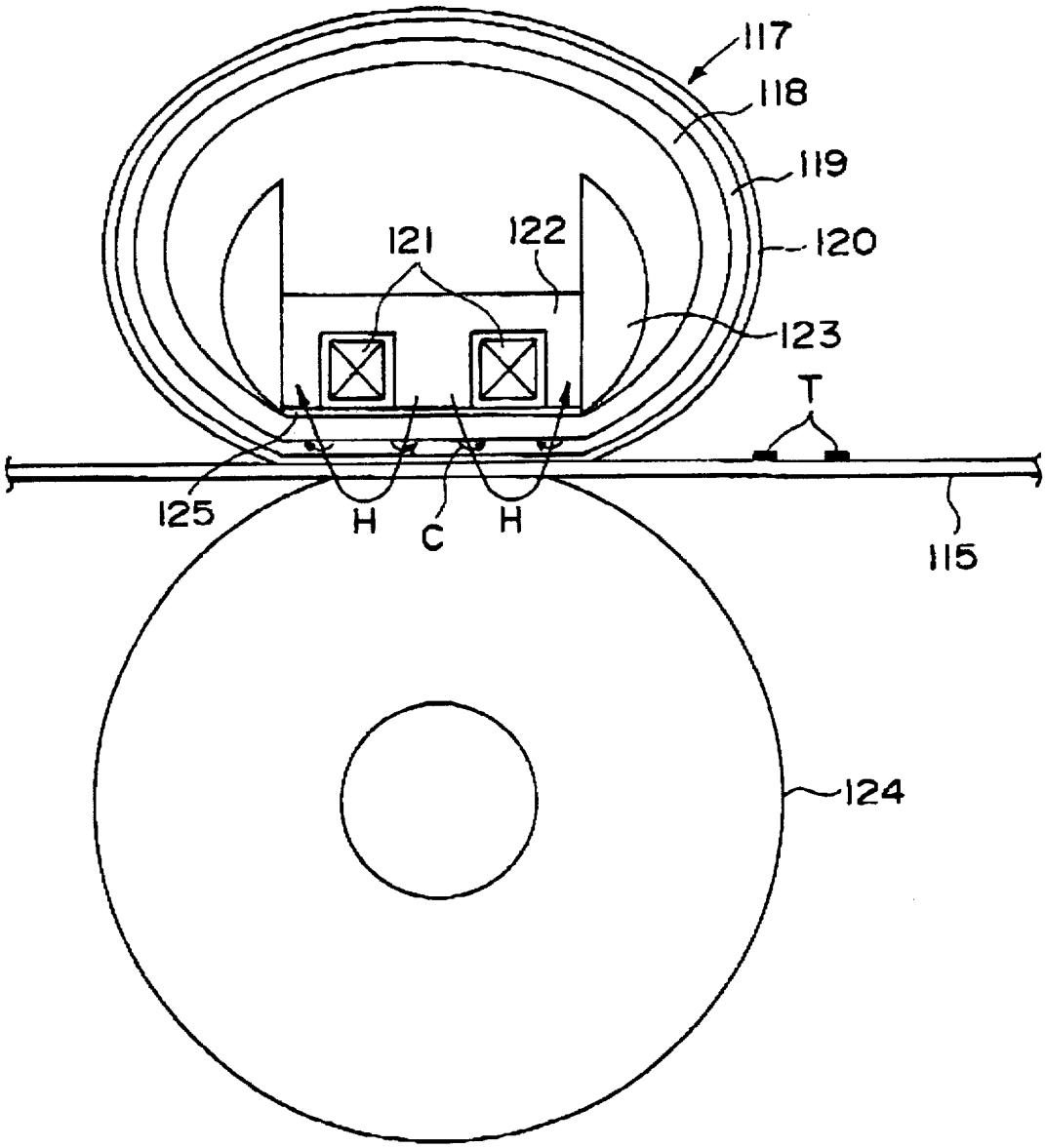
FIG. 12 is a detailed sectional view of the apparatus of FIG. 11.

FIGS. 11 and 12 are a sectional view and perspective view of a fixing device according to a first embodiment of the present invention. An unfixed toner image is formed on the recording material by an unshown image formation portion using an electrophotographic process, and the recording material is passed between a film 117 and a pressing roller 124 as shown in FIG. 12, by which the toner image is heated and fixed on the recording material.

Designated by a reference numeral 117 is a movable film and comprises a low thermal conductivity base 118 of a resin material such as polyimide, polyamideimide, PEEK, PES, PPS, PFA, PTFE, FEP or the like and having a thickness of 10–100 μm, an electrically conductive layer 119, thereon, of Fe, Co or plated Ni, Cu, Cr or another metal with a thickness of 1–100 μm, and an outermost surface parting layer 120, thereon, of one or more resin materials having a high heat resistivity and a high parting property such as PFA, PTFE, FEP, silicone resin or the like. A sliding plate 125 is stack to the core material 122 at the position of contact with the film to guide the movement of the film at the nip. The sliding plate 125 is of glass or the like exhibiting low friction relative to the film 117, and it is preferable that the surface thereof is coated with grease or oil. Alternatively, the core metal 122 may be provided with a flat surface for constituting the sliding portion. A pressing roller 124 comprises a core metal coated with the pressing roller 124 cooperates with a support (core member 122, stay 123 or the like) for supporting the coil 121 to form a nip with a film 177 therein. The coil 121 is disposed at a position opposed to the nip B. The pressing roller 124 Is driven by an unshown driving mechanism, so that the film 117 is rotated by the pressing roller. The recording material carrying an unfixed toner image is fed by the nip between the film 117 and the pressing roller 124, by which the recording material 115 is heated and pressed to fuse and fix the toner image. Arrow H indicates a magnetic flux produced around the coil 121, and arrow C indicates eddy currents produced in an electroconductive layer 119.

Figure 1:
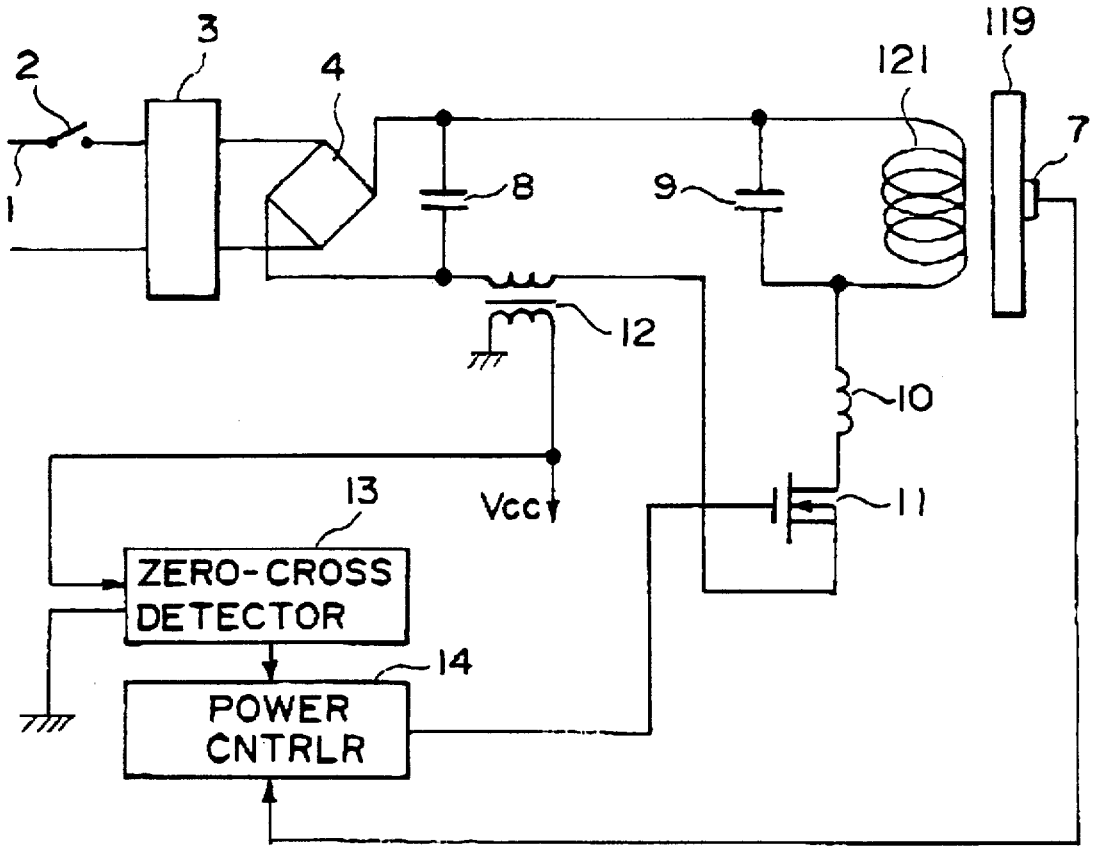
FIG. 1 is an energization control circuit diagram according to a first embodiment.

FIG. 1 shows embodiment 1.

In FIG. 1, reference numeral 1 designates an AC voltage source; 2 is a voltage source switch; 3 is a line filter; 4 is a rectifying device; 121 is an excitation coil; 119 is a rotatable member of electroconductive(metal) material functioning as a heat generating element; 7 is temperature sensor; 8 is a film capacitor; 9 is a resonance capacitor; 10 is a resonance coil; 11 is a switching element; 12 is a current transformer; 13 is a zero-cross detection circuit; and 14 is an electric power supply control circuit for rendering ON/OFF the switching element and for determinating an OFF time on the basis of a signal from the temperature sensor.

The current rectified by the rectifying device 4 is switched by the switch element 11. The switch element is on-off-controlled on the basis of the time determined through a method which will be described hereinafter, by a gate control circuit portion of the control circuit 14. When the voltage thus switched Is applied to the excitation coil, the magnetic field appears and disappears, and by the change of the magnetic field, the electromotive force is induced in the metal portion 119 in the metal heating film 117, and the current depending on the resistance value of the metal flows. In the metal, the heat generation occurs by the joule loss. The heat is used for image fixing. the film has a structure permitting easy heat transfer to the recording paper, as shown in FIG. 13.

When the switching element is turned on, the current flows through the resonance circuit comprising an excitation coil 121, resonance coil 10, resonance capacitor 9. The current changes at a resonance frequency or period of the series resonance(current resonance) circuit constituted by the resonance coil 10 and resonance capacitor 9, and thereafter, it stabilizes adjacent 0 Ampere.

If the switching element is opened before the current is stabilized at zero Ampere, the switching loss occurs.

According to this embodiment, however, the zero-cross detection circuit detects the timing at which the current through the switching element is small, and the electric power supply control circuit permits the switching element to open on the basis of the detected timing.

When the electric power supply control circuit receive the actuation signal from the zero-cross detection circuit, it renders the switching element OFF. Therefore, the ON time is determined by the resonance period of the series resonance circuit constituted by the resonance coil and the resonance capacitor. Thereafter, the electric power supply control means controls the number of ON-OFFs within a predetermined period of time on the basis of the temperature information from the temperature detecting means. Thus, the ratio (duty) between the ON time and the OFF time is controlled, by which the electric power control and therefore the temperature control are carried out.

More particularly, when the detected temperature of the temperature detecting element is higher than a target temperature, the switching element is not opened simultaneously with the zero-cross point detection, but is is opened with a delay.

The current detecting portion (zero-cross detection circuit) is operated on the basis of measurement of current or voltage between the contacts of the current transformer 12. The contacts may be used as a voltage source for the control circuit. In place of the current transformer, a detected resistance is usable. In this case, the current through the control circuit may be from a separate voltage source. As for the temperature detecting method for the heat generating element, detecting means using inductance change of the excitation coil is usable as well as a temperature detecting element such as thermister or the like.

Figure 2:
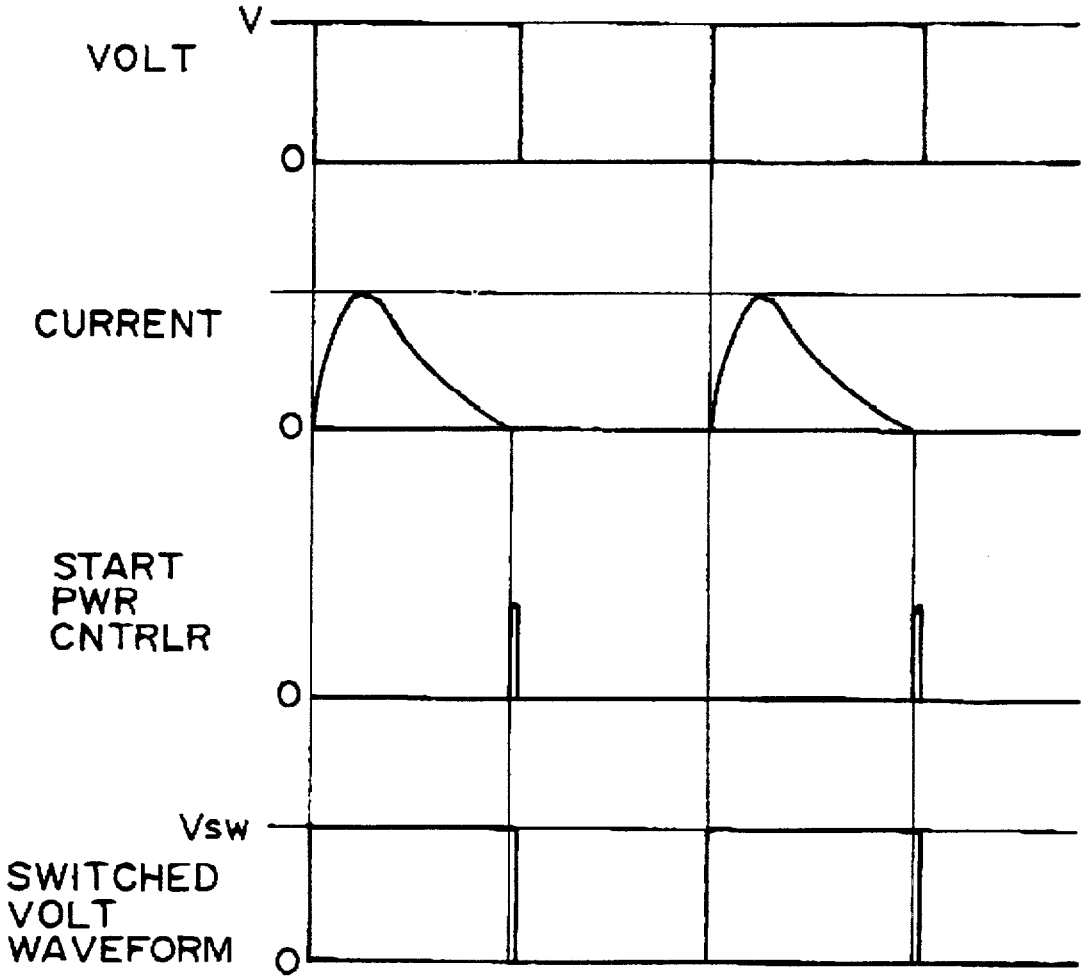
FIG. 2 shows a current waveform of a resonance circuit and an operation waveform of various parts.

FIG. 2 is an illustration of application of the actuation signal from the series resonance waveform to the electric power supply control circuit. In FIG. 2, designated by 1 is a voltage waveform as a result of PWM switching when there is no current detection. As shown in the Figure, the switching occurs at a predetermined frequency, and therefore, period. The current through the series resonance circuit has a waveform indicated by 2. The current detecting circuit (zero-cross circuit) applies an actuation signal to the electric power supply control circuit upon 0 of the current. The turn-off of the switching occurs with a delay determined by the circuit as counted from the actuation signal.

Figure 3:
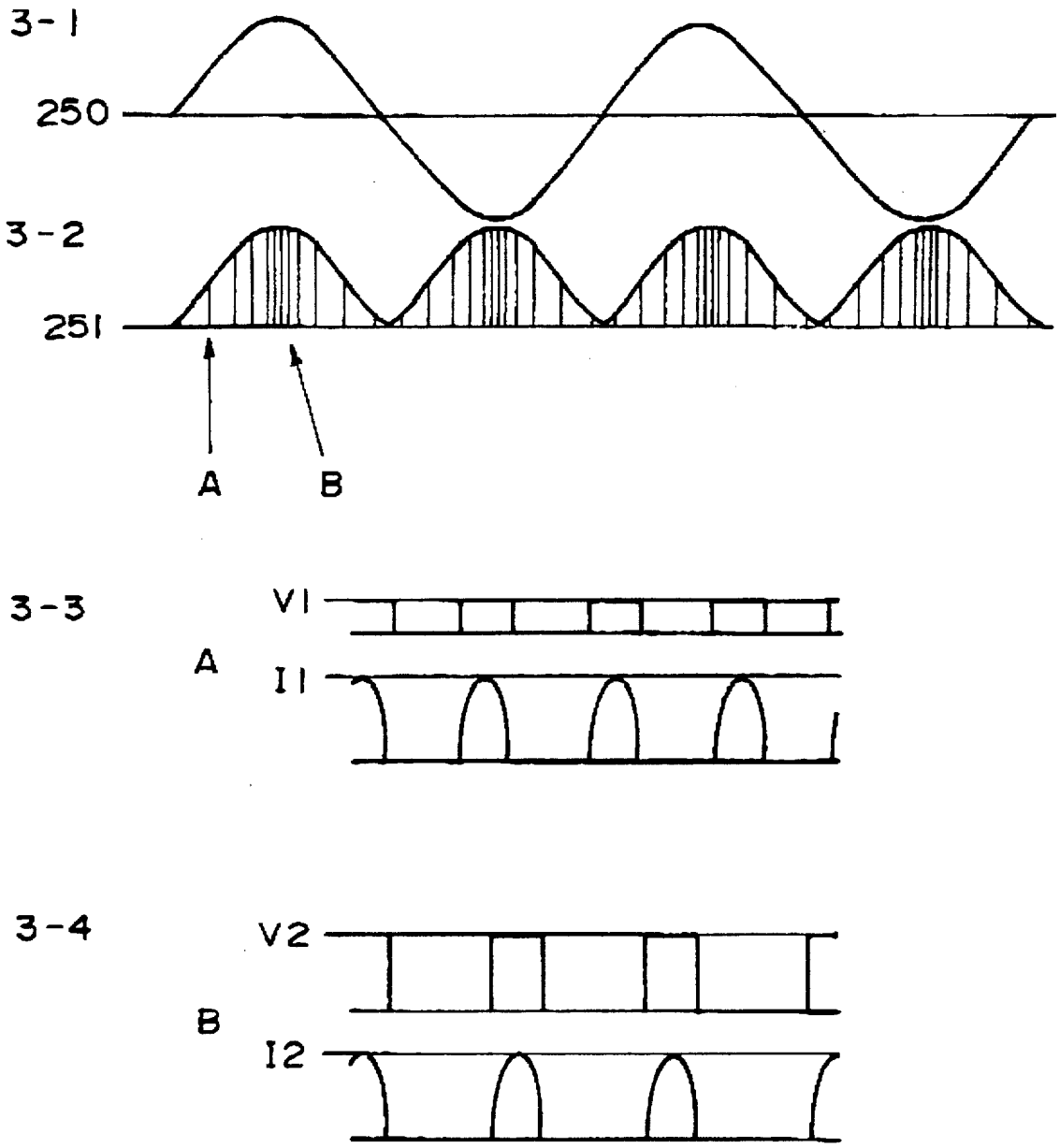
FIG. 3, which is comprised of waveforms 3-1, 3-2, 3-3, and 3-4, shows a current waveform of switch element when temperature control is effected.

FIG. 3 shows a current waveform in operation. In FIG. 3, 3-1 designates an Utility AC voltage source waveform; 3-2 is a waveform outputted through a rectification bridge 4; and 3-3 is a voltage and a current waveform when high frequency switching is carried out using the switching element (FET) to the rectified waveform 3-2. In addition, 3-4 is a switching waveform at a portion where the voltage is low in the rectification ripple. Thus, the switching period or frequency is modulated in accordance with the voltage of the input voltage waveform (utility AC voltage), since then the current waveform is close as much as possible to a sine wave current and then the power factor of the input current waveform of the current is improved. In order to accomplish this, the voltage appearing in the current transformer shown in FIG. 1 is monitored, and in accordance with the voltage, the capacitor by which the OFF time or period in the electric power supply control circuit is determined and the resistance by which the discharge current is regulated are controlled. The rectification wave ripple voltage inputted to an end of the coil accumulates the electric power in the excitation inductance of the field coil when the switching control is effected by the high frequency switching element, and it effects magnetic coupling with the heating element metal functioning as a load. By the magnetic field, the current flows, so that joule heat is produced due to the ohmic loss of the metal.

As described in the foregoing, in this embodiment, the switching element is opened after the zero-cross detection, and the comparison is made between the temperature information of the temperature detecting means and the reference temperature. The result of the comparison is fed back to the switching control circuit.

Embodiment 2

Figure 4:
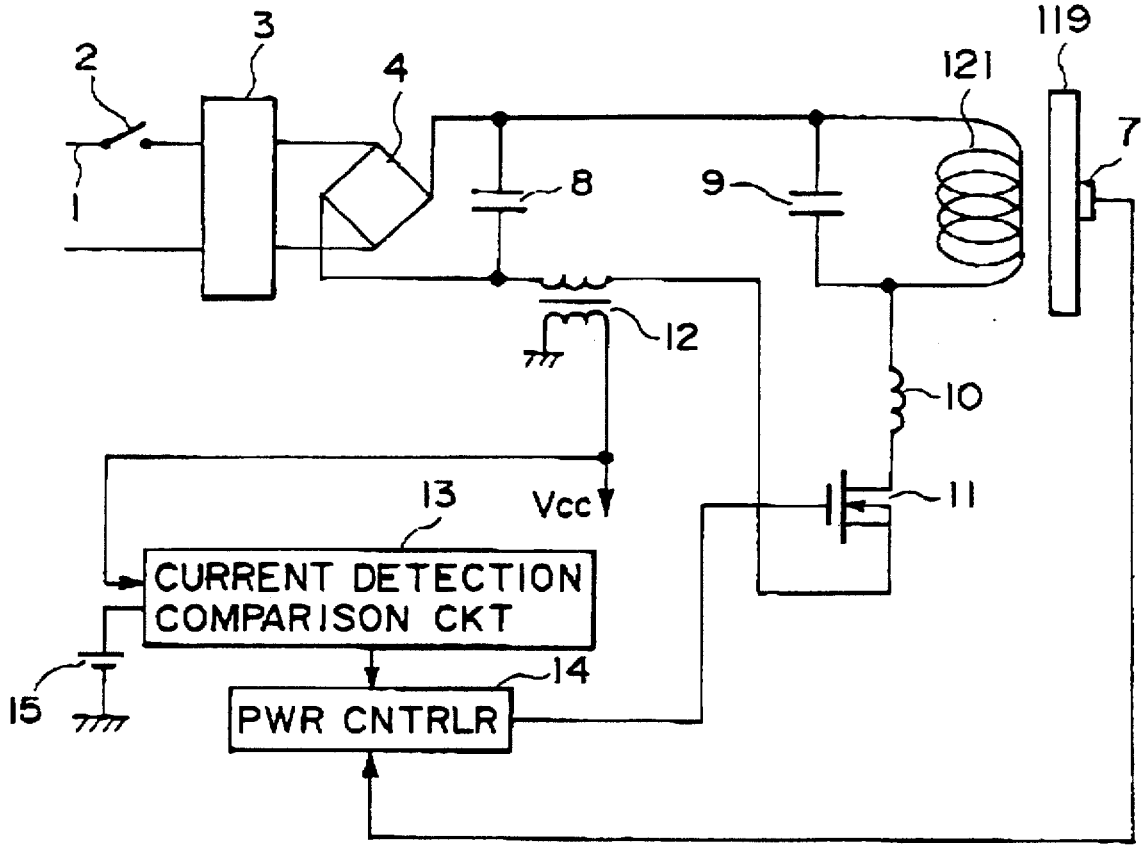
FIG. 4 is a circuit diagram according to Embodiment 2.

FIG. 4 shows embodiment 2 of the present invention.

In FIG. 4, reference numeral 1 designates an AC voltage source; 2 is a voltage source switch; 3 is a line filter; 4 is a rectifying device; 121 is an excitation coil; 119 is a rotatable member of metal; 7 is a temperature sensor; 8 is a film capacitor; 9 is a resonance capacitor; 10 is a resonance coil; 11 is a switching element; 12 is a current transformer; 13 is a current detection and comparator circuit; and 14 is an electric power supply control circuit for rendering ON/OFF the switching element and for determinating an OFF time on the basis of a signal from the temperature sensor. Designated by 15 is a reference voltage source.

The current rectified by the rectifying device 4 is switched by the switch element 11. The switch element is on-off-controlled on the basis of the time determined through a method which will be described hereinafter, by a gate control circuit portion of the control circuit 14.

When the switching element is turned on, the current flows through the resonance circuit comprising an excitation coil 121, resonance coil 10, resonance capacitor 9. the current changes at a resonance frequency or period of the series resonance (current resonance) circuit constituted by the resonance coil 10 and resonance capacitor 9, and thereafter, it converges to 0 Ampere.

However, when the current resonance is not sufficient like when the eddy current loss of the metal is very large, or when the electric power supply is too small, the current may not decrease to 0 but may converge to several Amperes. In this embodiment, the timing at which the current through the switching element is small is detected by current detection and comparator circuit, and the detected data is compared with a predetermined reference current. When the detected current is smaller than the reference value, the electric power supply control circuit opens the switching element on the basis of the detected timing. The current comparison may be effected on the basis of the voltage across a resistance caused by the detected current, the voltage being compared with a reference voltage. The detected current value may be compared with the reference current source.

When the electric power supply control circuit receives an actuation signal from the current detection and comparator circuit, it renders the switching element OFF. Therefore, the ON period is determined by the resonance period of the series resonance circuit constituted by the resonance coil and the resonance capacitor. Thereafter, the electric power supply control means controls the number of ON-OFFs within a predetermined period of time on the basis of the temperature information from the temperature detecting means. Thus, the ratio (duty) between the ON time and the OFF time by which the electric power control and therefore the temperature control are carried out.

Thus, the switching element is opened when the current through the switching element is not less than a predetermined level, so that the switching loss is minimized.

The current detecting portion is operated detecting the voltage or current appearing between the contacts of the current transformer 12. The contacts may be used for the voltage source for the control circuit. In place of the current transformer, a detected resistance is usable. In this case, the voltage source of the control circuit may be a separate voltage source. As for the temperature detecting method for the heat generating element, detecting means using inductance change of the excitation coil is usable as well as a temperature detecting element such as thermister or the like.

The description will be made as to the process from the series resonance waveform to the actuation signal to the OFF time control circuit.

Figure 5:
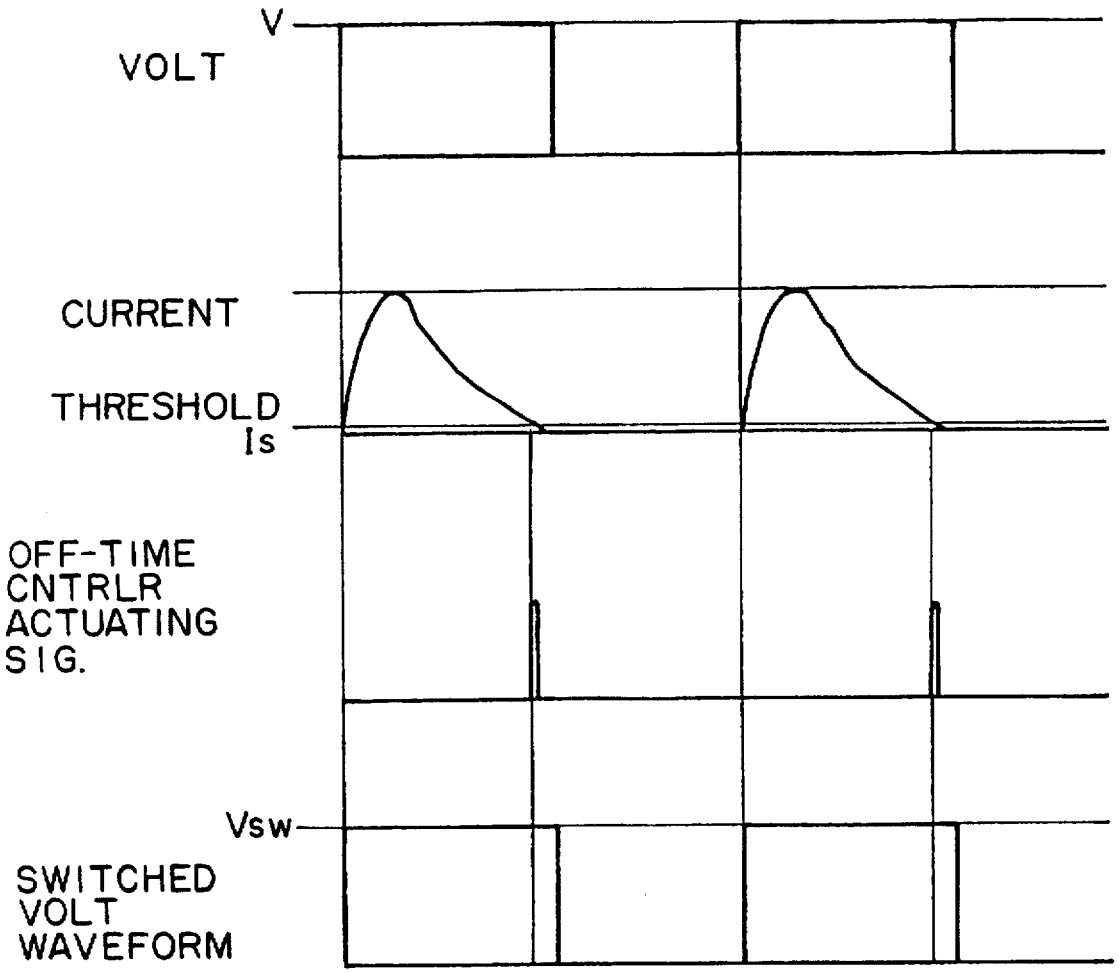
FIG. 5 shows an operation waveform in a device of Embodiment 2.

In FIG. 5, designated by 1 is a voltage waveform as a result of PWM switching when there is no current detection. As shown in the Figure, the switching occurs at a predetermined frequency, and therefore, period. The current through the series resonance circuit has a waveform indicated by 2. The current detection comparator circuit applies an actuation signal to the electric power supply control circuit when the current becomes lower than a threshold current. The switching is turned off with a delay time from the actuation signal.

Embodiment 3

Figure 6:
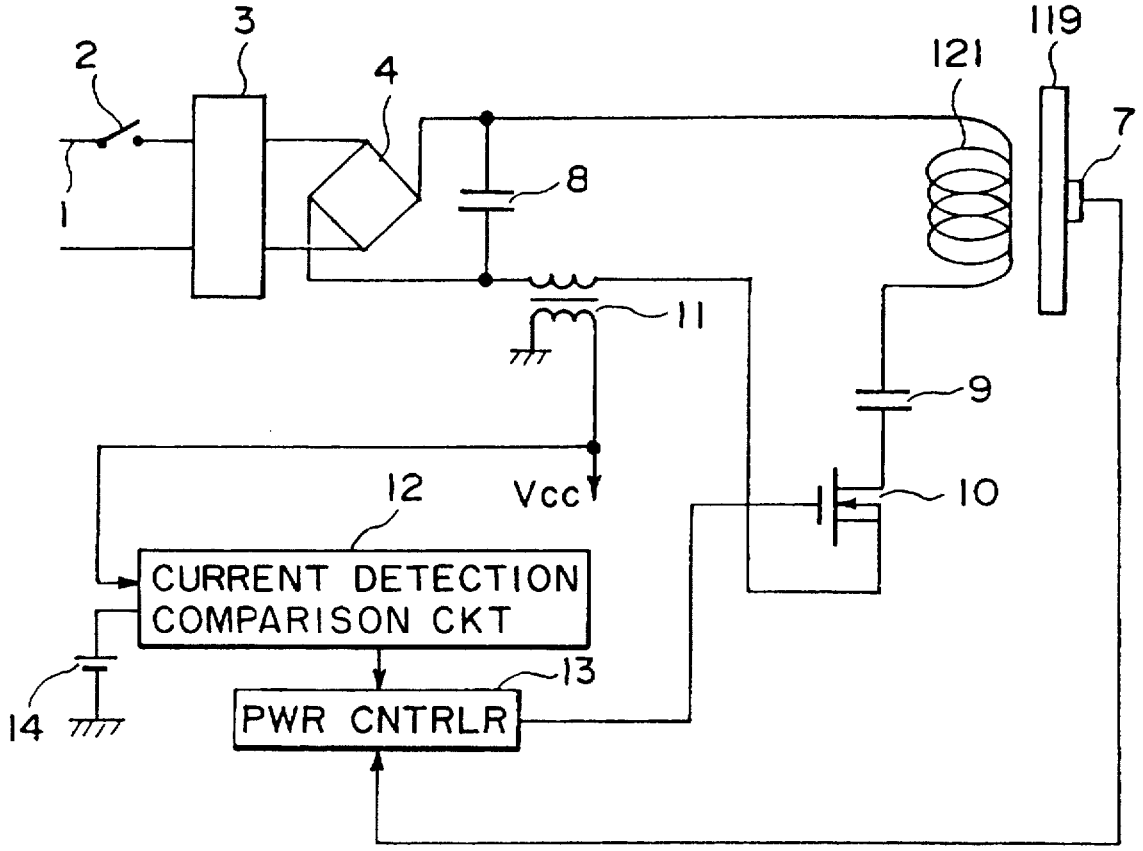
FIG. 6 is a circuit diagram according to Embodiment 3.

FIG. 6 shows embodiment 3.

In FIG. 6, reference numeral 1 designates an AC voltage source; 2 is a voltage source switch; 3 is a line filter; 4 is a rectifying device: 121 is an excitation coil; 119 is a rotatable member of metal; 7 is temperature sensor; 8 is a film capacitor; 9 is a resonance capacitor; 10 is a switching element; 11 is a current transformer; 12 is a current detection and comparator circuit; and 13 is an electric power supply control circuit for rendering ON/OFF the switching element and for determinating an OFF time on the basis of a signal from the temperature sensor. Designated by 14 is a reference voltage.

By using an excitation coil as a resonance coil, the influence of the magnetic coupling with the heating element appears in the resonance current and the resonance period, and therefore, the over-heating or fixing film abnormality can be detected by monitoring the resonance current and the resonance period.

Embodiment 4

Figure 7:
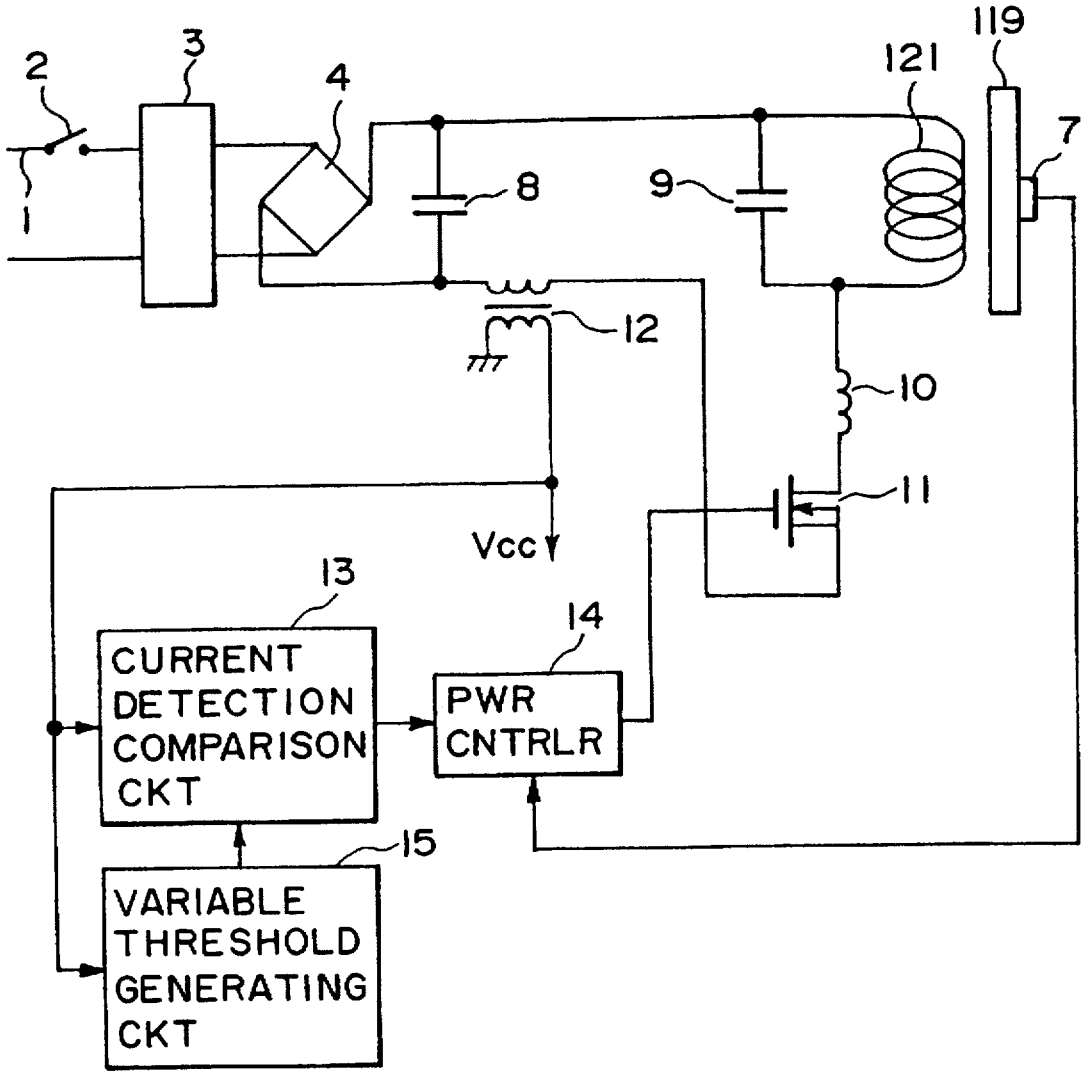
FIG. 7 is a circuit diagram according to Embodiment 4.

FIG. 7 shows embodiment 4

In FIG. 7, reference numeral 1 designates an AC voltage source; 2 is a voltage source switch; 3 is a line filter; 4 is a rectifying device; 121 is an excitation coil; 119 is a rotatable member of metal; 7 is temperature sensor: 8 is a film capacitor; 9 is a resonance capacitor; 10 is a resonance coil; 11 is a switching element; 12 is a current transformer; 13 is a current detection and comparator circuit; and 14 is an electric power supply control circuit for rendering ON/OFF the switching element and for determinating an OFF time on the basis of a signal from the temperature sensor. Designated by 15 is a variable threshold generating circuit.

The description will be made as to the process from the series resonance waveform to the actuation signal to the OFF time control circuit.

Figure 8:
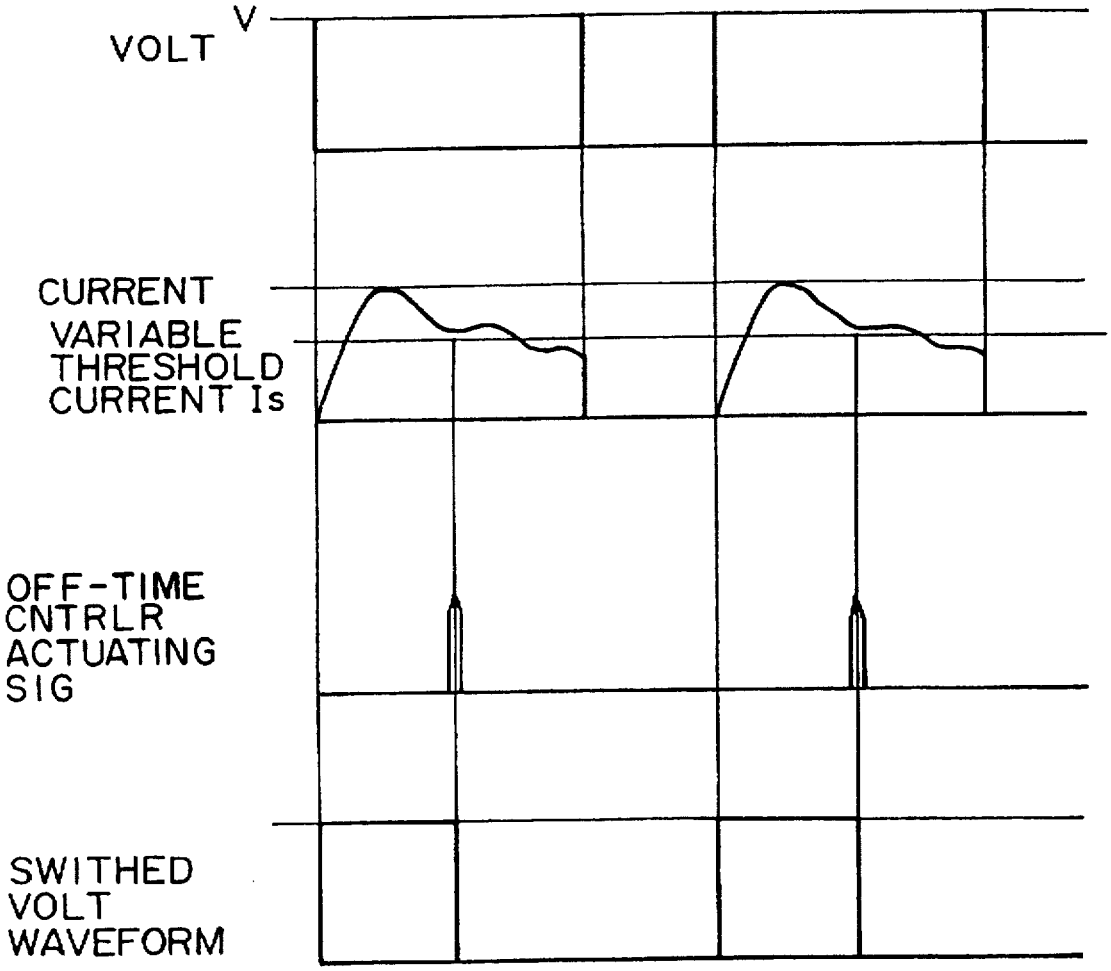
FIG. 8 shows an operation waveform.

In FIG. 8, designated by 1 is a voltage waveform as a result of PWM switching when there is no current detection. As shown in the Figure, the switching occurs at a predetermined frequency, and therefore, period. When the current through the series resonance circuit has a waveform as indicated by 2, the variable threshold generating circuit detects the portion at which the current is minimum in 1 period of the resonance. The current detection comparator circuit applies an actuation signal to the electric power supply control circuit when the current becomes lower than a threshold current is. The switching is turned off with a delay time from the actuation signal. In place of use of the variable threshold generating circuit and the current detection, a circuit for detecting an extremal value of the current change in the current detection comparator circuit.

Embodiment 5

Figure 9:
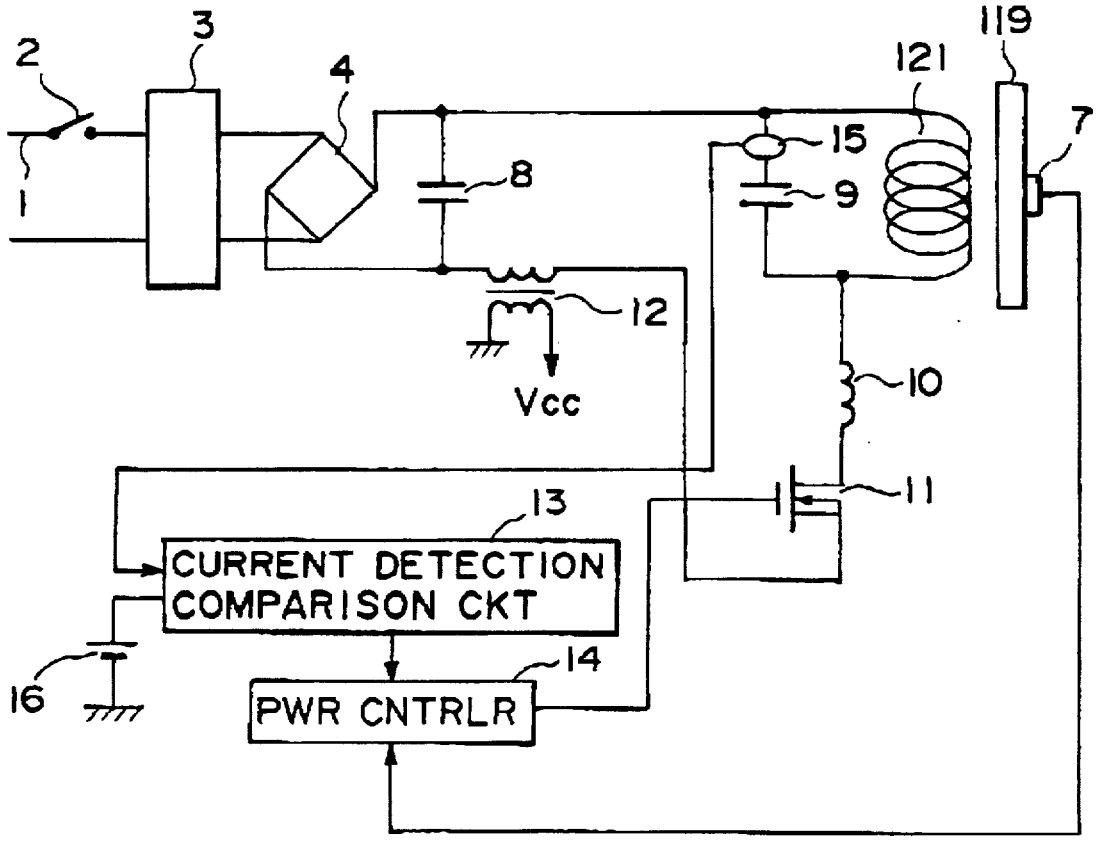
FIG. 9 is a circuit diagram according to Embodiment 5.
Figure 10:
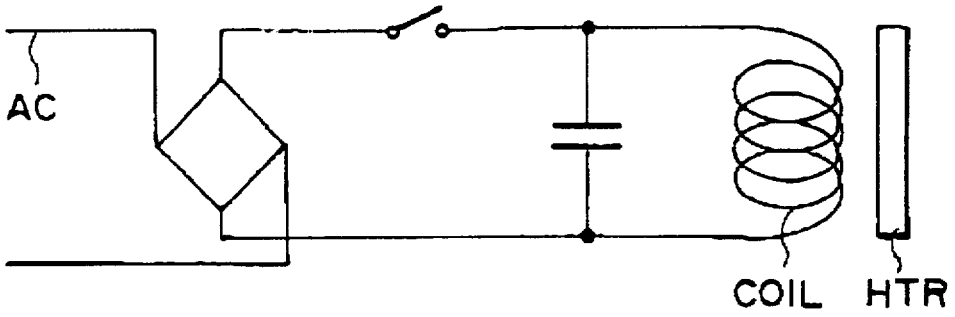
FIG. 10 is a schematic circuit diagram of an image heating device using the electromagnetic induction.

FIG. 9 shows embodiment 5.

In FIG. 9, reference numeral 1 designates an AC voltage source; 2 is a voltage source switch; 3 is a line filter; 4 is a rectifying device; 121 is an excitation coil; 119 is a rotatable member of metal; 7 is temperature sensor; 8 is a film capacitor 9 is a resonance capacitor; to is a resonance coil; 11 is a switching element; 12 is a current transformer; 13 is a current detection and comparator circuit; and 14 is an electric power supply control circuit for rendering ON/OFF the switching element and for determinating an OFF time on the basis of a signal from the temperature sensor. Designated by 15 is a current detecting means.

The current flowing through the series resonance circuit per se is detected. This current necessarily has a waveform of current as shown in FIG. 2-2 or a sinusoidal wave vibration waveform including attenuation with the reference of the current of 0 A (Ampere). The waveform is not a DC plus ripple wave. Therefore, it is very easy of catch the wave node of the waveform or the period of the resonance. On the basis of the detection of the current, an actuation signal is applied to the electric power supply control circuit.

The current detection may compare the detection with a reference current predetermined by the current detection and comparator circuit. The comparison may be with a variable threshold of the variable threshold circuit.

It is a further alternative that the current through the switching element is monitored, and the data is processed in relation with the resonance current, and thereafter, it may be determined.

In the above-described induction heat-fixing device, a timer having a capacitor and a resistance may be provided to start the discharge with the time constant determined by the resistance and the capacitor charged to the voltage V1 which is predetermined, in response to a signal indicative of the actuation of the switch element. When the capacitor voltage lowers to V2 in a predetermined period of time, the switching element is deactuated. By doing so, the switch element can be rendered OFF even if the OFF signal is not produced in a predetermined period. The time period from V1 to V2, may by an integer multiple of the resonance period of the series resonance circuit.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

an electroconductive heat generating element;

an excitation coil for producing a magnetic flux, said excitation coil produces a magnetic flux which is effective to generate eddy current in said electroconductive heat generating element to generate heat in said electroconductive heat generating element;

an electric circuit for energizing said excitation coil, said electric circuit having a series resonance circuit and a switching element connected with said series resonance circuit;

a current detecting element for detecting a current through said series resonance circuit:

a temperature detecting element for detecting a temperature of said electroconductive heat generating element;

electric power supply control means connected to said current detecting element, said temperature detecting element, and said switching element for controlling said switching element to effect switching between an energization state and non-energization state for said series resonance circuit, wherein said control means controls said switching element in accordance with both of the current through said series resonance circuit detected by said current detecting element and the temperature detected by said temperature detecting element.

2. An apparatus according to claim 1, wherein said electric power supply control means controls an open timing of said switching element in accordance with the current through said switching element detected by said current detecting element.

3. An apparatus according to claim 2, said current detecting element comprising a zero-cross detecting means for applying a signal to said electric power supply control means, when the current through said switching element after energization to said series resonance circuit, and wherein said electric power supply control means opens said switching element on the basis of the signal.

4. An apparatus according to claim 2, further comprising a comparator circuit for applying a signal to said electric power supply control means when a current through said switching element takes a predetermined level.

5. An apparatus according to claim 1, wherein said electric power supply control means controls said switching element so as to substantially maintain a target temperature.

6. An apparatus according to claim 5, wherein when the detected temperature of said temperature detecting element is higher than the target temperature, said electric power supply control means reduces the number of opening and short circuit operations of the switching element, and when it is lower than the target temperature, it is reduced.

7. An apparatus according to claim 1, wherein said switching element includes a FET (Field Effect Transistor).

8. An apparatus according to claim 1, further comprising a film in slidable contact with said electroconductive heat generating element and movable with a recording material.

9. An apparatus according to claim 1, wherein said electroconductive heat generating element is in the form of a film movable with the recording material carrying a toner image.

10. An image fixing means of an image forming apparatus including an image heating apparatus for forming a toner image on a recording material, comprising:

an electroconductive heat generating element;

an excitation coil for producing a magnetic flux, said excitation coil produces a magnetic flux which is effective to generate eddy current in said electroconductive heat generating element to generate heat in said electroconductive heat generating element;

an electric circuit for energizing said excitation coil, said electric circuit having a series resonance circuit and a switching element connected with said series resonance circuit;

a current detecting element for detecting a current through said series resonance circuit;

a temperature detecting element for detecting a temperature of said electroconductive heat generating element;

electric power supply control means connected to said current detecting element, said temperature detecting element, and said switching element for controlling said switching element to effect switching between an energization state and non-energization state for said series resonance circuit, wherein said control means controls said switching element in accordance with both of the current through said series resonance circuit detected by said current detecting element and the temperature detected by said temperature detecting element.

* * * * *

UNITED STATES PATENT AND TRADEMARK OFFICE

CERTIFICATE OF CORRECTION

PATENT NO. : 5,783,806

DATED : July 21, 1998

INVENTOR(S) : MINORU HAYASAKI

It is certified that error appears in the above-identified patent and that said Letters Patent is hereby corrected as shown below:

COLUMN 1:

Line 17, "showed" should read --shown--.

COLUMN 2:

Line 62, "Is" should read --is--.

COLUMN 3:

Line 21, "Is" should read --is--; and
Line 45, "receive" should read --receives--.

COLUMN 5:

Line 3, "the" should read --The--.

COLUMN 6:

Line 43, "extremal" should read --extreme--; and
Line 52, "to" should read --121--.

UNITED STATES PATENT AND TRADEMARK OFFICE

CERTIFICATE OF CORRECTION

PATENT NO. : 5,783,806

DATED : July 21, 1998

INVENTOR(S) : MINORU HAYASAKI

It is certified that error appears in the above-identified patent and that said Letters Patent is hereby corrected as shown below:

Column 4:)

Line 19, "an Utility" should read --a utility--

Signed and Sealed this

Fourteenth Day of November, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,783,806
DATED : July 21, 1998
INVENTOR(S) : Hayasaki

It is certified that error appears in the above-identified patent and that said Letters Patent is hereby corrected as shown below:

Title page,
Item [73], Assignee should read -- Canon Kabushiki Kaisha --

Signed and Sealed this

Second Day of April, 2002

*Attest:*

*Attesting Officer*

JAMES E. ROGAN
*Director of the United States Patent and Trademark Office*